United States Patent [19]

Haas

[11] 4,444,569

[45] Apr. 24, 1984

[54] GASIFICATION PROCESS FOR CARBONACEOUS MATERIALS

[75] Inventor: John C. Haas, El Sobrante, Calif.

[73] Assignee: Chevron Research Company, San Francisco, Calif.

[21] Appl. No.: 457,855

[22] Filed: Jan. 14, 1983

[51] Int. Cl.[3] ..... C10J 3/46; C10J 3/54

[52] U.S. Cl. ..... 48/197 R; 48/202

[58] Field of Search ..... 48/197 R, 202, 206, 48/210, DIG. 4; 252/373

[56] References Cited

U.S. PATENT DOCUMENTS

| | | | |
|---|---|---|---|
| 2,631,921 | 3/1953 | Odell | 48/206 |
| 2,686,113 | 8/1954 | Odell | 48/206 |
| 3,884,649 | 5/1975 | Matthews | 48/206 |
| 4,157,245 | 6/1979 | Mitchell et al. | 48/197 R |

*Primary Examiner*—Peter F. Kratz

*Attorney, Agent, or Firm*—S. R. LaPaglia; E. A. Schaal

[57] ABSTRACT

A carbonaceous material, such as coal, is gasified in a vertically elongated reaction vessel having a lower portion, an upper portion, and a re-entrainment zone which is located above the upper portion. The effective diameter of the upper portion of the vessel is larger than that of the lower portion of the vessel and the re-entrainment zone. A gasification agent is passed upwardly through the vessel at a rate sufficient to entrain the coal and fluidize a heat-transfer material in the lower portion of the vessel. The gasification agent reacts with the coal to form a hot char and a gaseous product, with the necessary heat being supplied by the heat-transfer material. In this process, the heat-transfer material substantially flows downwardly in the reaction vessel, in a fluidized state or an unfluidized state through the upper portion of the vessel and in a fluidized state through the lower portion of the vessel. The coal substantially flows upwardly in the reaction vessel, in an entrained state through the lower portion of the vessel and the re-entrainment zone, and in a fluidized state through the upper portion of the vessel. An advantage of this process is that the upper portion serves to increase the residence time of the carbonaceous solids in the reaction vessel thereby increasing yields and lowering the average height of the reaction vessel, and the sensible heat is extracted from the product gas before it leaves the reactor.

7 Claims, No Drawings

GASIFICATION PROCESS FOR CARBONACEOUS MATERIALS

BACKGROUND OF THE INVENTION

The present invention involves an improved method for gasification of carbonaceous materials.

In view of recent increases in the price of crude oil, researchers have been searching for alternative sources of energy and hydrocarbons. Much research has focused on recovering the hydrocarbons from hydrocarboncontaining solids such as shale, tar sand or coal by heating or pyrolysis to boil off or liquefy the hydrocarbons trapped, in the solid or by reacting the solid with steam, for example, to convert components of solid carbonaceous material into more readily usable gaseous and liquid hydrocarbons. Other known processes involve combustion of the solid carbonaceous materials with an oxygen-containing gas to generate heat. Such processes conventionally employ a treatment zone, e.g., a reaction vessel, in which the solid is heated or reacted.

In a typical coal gasification process, coal is contacted with steam and an oxygen-containing gas to produce a gaseous product.

When air is used as the oxygen-containing gas, the gaseous product contains high levels of nitrogen, which reduces the BTU content of the gaseous product. Some processes have used pure oxygen instead of air, in order to avoid having nitrogen in the gaseous product. This does eliminate the nitrogen from the product but it requires a source of pure oxygen, some oxygen plants are almost as large as the coal gasification plant they are supplying. Thus, one was faced with the alternatives of either producing a gaseous product diluted with nitrogen or finding a source of pure oxygen for their process.

Another solution to the nitrogen dilution problem is disclosed in U.S. Pat. No. 4,157,245. In one embodiment of the invention disclosed in that patent, a solid heat-transfer material, such as sand, is introduced into an upper portion of a reaction vessel and coal is introduced into a lower portion of the vessel. The physical characteristics of the heat-transfer material and the coal differ such that a superficial velocity of a fluid flowing upwardly through the vessel is greater than the minimum fluidizing velocity of the heat-transfer material and the terminal velocity of the coal, but is less than the terminal velocity of the heat-transfer material. A substantially countercurrent vertical flow of the two solids is maintained in the vessel without substantial top-to-bottom backmixing by passing steam upwardly through the vessel at a rate sufficient to fluidize the heat-transfer material and entrain the coal whereby the heat-transfer material substantially flows downwardly in a fluidized state through the vessel and the coal substantially flows upwardly in an entrained state through the vessel. The steam reacts with the coal to form a hot char and a gaseous product. The heat-transfer material acts as a source of heat for the reaction between the steam and the coal. Cooled heat-transfer material is removed from a lower end of the vessel and the hot char and the gaseous product are removed from an upper end of the vessel. The gaseous product is then separated from the hot char by regular separation techniques.

In one method, the heat-transfer material can be heated by introducing it into an upper portion of a combustion zone, introducing the hot char into a lower portion of the zone, and contacting the heat-transfer material with the hot char while maintaining substantially countercurrent plug flow of the two solids by passing air upwardly through the combustion zone at a rate sufficient to fluidize the heat-transfer material and entrain the char. The heat-transfer material substantially flows downwardly through the combustion zone in a fluidized state and is heated while the char substantially flows upwardly through the combustion zone in an entrained state and is combusted.

The process in U.S. Pat. No. 4,157,245 is based in part on the discovery that in the typical coal gasification process, there are two separate reactions occurring in the same vessel: (1) an endothermic reaction between the coal and steam which produces the gaseous product, and (2) an exothermic reaction between the coal and the oxygen-containing gas which produces the heat necessary for the first reaction. The process of U.S. Pat. No. 4,157,245 separates these two reactions in two separate vessels and transfers the heat generated by the second reaction to the site of the first reaction via a heat-transfer material.

A major advantage of this process is that air can be used as the oxidizing gas without causing the resulting gaseous product to be diluted with nitrogen.

In order to maintain the process efficiency of this process, one must achieve high conversion in the gasifier. While this high conversion is easily achievable with high reactivity lignite, it could present a problem with low reactivity material such as petroleum coke, chars and certain low reactivity coals. One solution is to use alkali salts such as potassium or calcium compounds to catalyze the gasification reactions.

SUMMARY OF THE INVENTION

The present invention overcomes the deficiencies of the prior art by using as a reaction vessel, a vertically elongated reaction vessel having a lower portion and an upper portion. The effective diameter of the upper portion of the vessel is larger than the effective diameter of the lower portion of the vessel. This reaction vessel has a means for substantially impeding vertical backmixing of solids in the vessel.

A carbonaceous material is introduced into the lower portion of the reaction vessel, and a solid heat-transfer material is introduced into the upper portion of the vessel. The physical characteristics of the heat-transfer material and the carbonaceous material must differ such that a superficial velocity of steam flowing upwardly through the lower portion of the vessel is greater than the minimum fluidizing velocity of the heat-transfer material and the terminal velocity of the carbonaceous material, but is less than the terminal velocity of the heat-transfer material. Steam is then passed upwardly through the vessel at a rate sufficient to fluidize the heat-transfer material and entrain the carbonaceous material in the lower portion of the vessel to maintain substantially countercurrent vertical flow of the heat-transfer material and carbonaceous material in the vessel without substantial top-to-bottom backmixing of the heat-transfer material and the carbonaceous material in the lower portion of the vessel. The steam reacts with the carbonaceous material to form a hot char and a gaseous product, with the heat necessary for this reaction being supplied by the heat-transfer material. The heat-transfer material substantially flows downwardly in the reaction vessel, in a fluidized state or an unfluidized state as jetsum through the upper portion of the vessel and in a fluidized state through the lower portion of the vessel. The carbonaceous material substantially flows upwardly in the reaction vessel, in an entrained state through the lower portion of the vessel and in a fluidized state through the upper portion of the vessel. Then the heat-transfer material is removed from the lower portion of the vessel at a temperature substantially lower than the temperature at which the heat-transfer material was introduced into the vessel, the hot char and the gaseous product are removed from the reentrainment zone of the vessel, and the hot char is separated from the gaseous product.

Preferably, the reaction vessel has a reentrainment zone located above the upper portion of the reaction vessel. The effective diameter of this reentrainment zone is equal to or less than the effective diameter of the lower portion of the reaction vessel. During the gasification process, the carbonaceous material substantially flows upwardly through the re-entrainment zone in an entrained state. Preferably, the carbonaceous material is coal and the heat-transfer material is sand.

The heat-transfer material can be heated by introducing at least a portion of the heat-transfer material into an upper portion of a vertically elongated combustion zone having means for substantially impeding vertical backmixing of vertically moving solids substantially throughout the combustion zone, introducing at least a portion of the hot char into a lower portion of the combustion zone, heating the heat-transfer material to an elevated temperature in the combustion zone by contacting the heat-transfer material with the hot char while maintaining substantially countercurrent plug flow of the heat-transfer material and the hot char by passing air upwardly through the combustion zone at a rate sufficient to fluidize the heat-transfer material and entrain the hot char, and recycling at least a portion of the heat-transfer material to the reaction vessel. The heat-transfer material substantially flows downwardly through the combustion zone in a fluidized state and is heated to an elevated temperature while the hot char substantially flows upwardly through the combustion zone in an entrained state and is combusted.

DESCRIPTION OF THE PREFERRED EMBODIMENTS

In its broadest aspect, the present invention involves the use of a vertically elongated reaction vessel having a lower portion and an upper portion, wherein the effective diameter of the upper portion of the vessel is larger than the effective diameter of the lower portion of the vessel. This reaction vessel must have a means for substantially impeding vertical backmixing of vertically moving solids in the vessel.

Generally, a carbonaceous material is introduced into a lower portion of a vessel, and a solid heat-transfer material is introduced into the upper portion of the vessel. The physical characteristics of the heat-transfer material and the carbonaceous material differ such that a superficial velocity of a fluid flowing upwardly through the lower portion of the vessel is greater than the minimum fluidizing velocity of the heat-transfer material and the terminal velocity of the carbonaceous material, but is less than the terminal velocity of the heat-transfer material. Then a gasification agent, such as steam is passed upwardly through the vessel at a rate sufficient to fluidize the heat-transfer material and entrain the carbonaceous material in the lower portion of the vessel to maintain substantially countercurrent vertical flow of the heat-transfer material and carbonaceous material in the vessel without substantial top-to-bottom backmixing of the heat-transfer material and the carbonaceous material in the lower portion of the vessel. The steam reacts with the carbonaceous material to form a hot char and a gaseous product which are removed from the vessel, and the hot char is separated from the gaseous product. The heat necessary for this reaction is supplied by the heat-transfer material. The heat-transfer material substantially flows downwardly in the reaction vessel, in either a fluidized state or an unfluidized state through the upper portion of the vessel and in a fluidized state through the lower portion of the vessel, then is removed from the lower portion of the vessel at a temperature substantially lower than the temperature at which the heat-transfer material was introduced into the vessel. The carbonaceous material substantially flows upwardly in the reaction vessel, in an entrained state through the lower portion of the vessel and in a fluidized state through the upper portion of the vessel.

The heat-transfer material could be introduced at any level in the upper portion, depending on the amount of sensible heat available in the product gas. If little sensible heat was available in the product gas, the heat-transfer material would be introduced at the top of the reaction vessel, thereby providing heat for the endothermic gasification reactions.

An advantage of having the upper portion is that the residence time of the carbonaceous solids can be increased without upsetting the careful balance of conditions that allow countercurrent plug flow in the lower portion, thereby increasing carbon conversion and lowering the total height of the vessel.

The fine carbonaceous material could be removed through an overflow weir or preferably by having a reentrainment zone located above the upper portion of the reaction vessel, wherein the effective diameter of the reentrainment zone is equal to or less than the effective diameter of the lower portion of the reaction vessel. When a re-entrainment zone is used, the carbonaceous material would be re-entrained, then the material substantially flows upwardly in an entrained state through the re-entrainment zone and transported out of the reactor vessel. In one embodiment, the effective diameter of the lower portion of the reaction vessel is greater than the effective diameter of the re-entrainment zone.

Although there is a wide variety of heat-transfer materials that can be used, the preferred heat-transfer material is sand. Sand is preferred because it is plentiful and inexpensive.

The present invention can be used in the processes disclosed in U.S. Pat. No. 4,157,245. U.S. Pat. No. 4,157,245 is hereby incorporated by reference to disclose a coal gasification process which can be benefited by this process.

U.S. Pat. No. 4,157,245 discloses that one method of heating a heat-transfer material is to introduce at least a portion of the heat-transfer material into an upper portion of a vertically elongated combustion zone having means for substantially impeding vertical backmixing of vertically moving solids substantially throughout the combustion zone, and introduce at least a portion of the hot char into a lower portion of the combustion zone. The heat-transfer material is heated to an elevated temperature in the combustion zone by contacting the heat-transfer material with the hot char while maintaining substantially countercurrent plug flow of the heat-transfer material and the hot char by passing air upwardly through the combustion zone at a rate sufficient to fluidize the heat-transfer material and entrain the hot char. The heat-transfer material substantially flows downwardly through the combustion zone in a fluidized state and is heated to an elevated temperature while the hot char substantially flows upwardly through the combustion zone in an entrained state and is combusted. At least a portion of the heat-transfer material is recycled to the reaction vessel.

In one particular embodiment of the present invention, a coal is introduced into a lower portion of a vertically elongated reaction vessel having a means for substantially impeding vertical backmixing of vertically moving solids in the vessel. Sand is introduced into an upper portion of the vessel. This reaction vessel has a lower portion, an upper portion, and a re-entrainment zone. The re-entrainment zone is located above the upper portion, and has an effective diameter which is less than or equal to the effective diameter of the lower portion of the vessel. The effective diameter of the upper portion of the vessel is larger than the effective diameter of both the re-entrainment zone and the lower portion of the vessel. The physical characteristics of the sand and the coal differ such that a superficial velocity of a fluid, such as steam, flowing upwardly through the lower portion of the vessel is greater than the minimum fluidizing velocity of the sand and the terminal velocity of the coal, but is less than the terminal velocity of the sand.

Then steam is passed upwardly through the vessel at a rate sufficient to fluidize the sand and entrain the coal in the lower portion of the vessel to maintain substantially countercurrent vertical flow of the sand and coal in the vessel without substantial top-to-bottom backmixing of the sand and the coal in the lower portion of the vessel. The steam reacts with the coal to form a hot char and a gaseous product, wherein the heat necessary for this reaction is supplied by the sand. The sand substantially flows downwardly in the reaction vessel, in either an unfluidized state or a fluidized state through the upper portion of the vessel and in a fluidizing state through the lower portion of the vessel, then is removed from the lower portion of the vessel at a temperature substantially lower than the temperature at which it was introduced into the vessel. The coal substantially flows upwardly in the reaction vessel, in an entrained state through the lower portion of the vessel and the reentrainment zone, and in a fluidized state through the upper portion of the vessel. The hot char and the gaseous product are removed from the re-entrainment zone of the vessel, and the hot char is separated from the gaseous product.

In the second part of this embodiment, at least a portion of the sand is introduced into an upper portion of a vertically elongated combustion zone having means for substantially impeding vertical backmixing of vertically moving solids substantially throughout the combustion zone, and at least a portion of the hot char is introduced into a lower portion of the combustion zone. The sand is heated to an elevated temperature in the combustion zone by contacting the sand with the hot char while maintaining substantially countercurrent plug flow of the sand and the hot char by passing air upwardly through the combustion zone at a rate sufficient to fluidize the sand and entrain the hot char. The sand substantially flows downwardly through the combustion zone in a fluidized state and is heated to an elevated temperature while the hot char substantially flows upwardly through the combustion zone in an entrained state and is combusted. Then at least a portion of the sand is recycled to the reaction vessel.

Although the above embodiment deals with the gasification of coal, this process can be used for the gasification of other carbonaceous materials such as organic char and coke products. Also, catalysts can be incorporated into the coal to catalyze the gasification reaction. The use of such catalysts as alkali metal compounds are well known in the art. Also, sulfur getters, such as compounds of alkaline earth metals, can also be incorporated into the coal in this process to remove any sulfur generated by the process. Other gasification agents can be used instead of steam, such as $CO_2$ or $H_2$.

While the present invention has been described with reference to specific embodiments, this application is intended to cover those various changes and substitutions which may be made by those skilled in the art without departing from the spirit and scope of the appended claims.

What is claimed is:

1. A method for gasification of carbonaceous material comprising:

(a) introducing a carbonaceous material into a lower portion of a vertically elongated reaction vessel having a lower portion and an upper portion, wherein the effective diameter of the upper portion of said vessel is larger than the effective diameter of the lower portion of said vessel, wherein said reaction vessel has a means for substantially impeding vertical backmixing of vertically moving solids in said vessel;

(b) introducing a solid heat-transfer material into the upper portion of said vessel, the physical characteristics of said heat-transfer material and said carbonaceous material differing such that a superficial velocity of a fluid flowing upwardly through the lower portion of said vessel is greater than the minimum fluidizing velocity of the heat-transfer material and the terminal velocity of the carbonaceous material, but is less than the terminal velocity of the heat-transfer material;

(c) passing a gasification agent upwardly through said vessel at a rate sufficient to fluidize the heat-transfer material and entrain the carbonaceous material in the lower portion of said vessel to maintain substantially countercurrent vertical flow of the heat-transfer material and carbonaceous material in the said vessel without substantial top-to-bottom backmixing of the heat-transfer material and the carbonaceous material in the lower portion of said vessel; whereby the gasification agent reacts with the carbonaceous material to form a hot char and a gaseous product, wherein the heat necessary for this reaction is supplied by the heat-transfer material; whereby the heat-transfer material substantially flows downwardly in the reaction vessel, through the upper portion of said vessel and in a fluidized state through the lower portion of said vessel; whereby the carbonaceous material substantially flows upwardly in the reaction vessel, in an entrained state through the lower portion of said vessel and in a fluidized state through the upper portion of said vessel;

(d) removing the heat-transfer material from the lower portion of said vessel at a temperature substantially lower than the temperature at which the heat-transfer material was introduced into said vessel;

(e) removing the hot char and the gaseous product from said vessel; and (f) separating the hot char from the gaseous product.

2. A method for the gasification of a carbonaceous material according to Claim 1 wherein said reaction vessel has a re-entrainment zone located above the upper portion of the reaction vessel, wherein the effective diameter of the re-entrainment zone is less than the effective diameter of the upper portion of the reaction vessel, and where the carbonaceous material substantially flows upwardly in an entrained state through the re-entrainment zone.

3. A method for the gasification of a carbonaceous material according to Claim 2 wherein the effective diameter of the lower portion of the reaction vessel is greater than the effective diameter of the re-entrainment zone.

4. A method for the gasification of a carbonaceous material according to Claim 1 wherein said carbonaceous material is coal and said gasification agent is steam.

5. A method for the gasification of a carbonaceous material according to Claim 1 wherein said heat-transfer material is sand.

6. A method for the gasification of a carbonaceous material according to Claim 1 comprising the additional steps of:

(g) introducing at least a portion of the heat-transfer material into an upper portion of a vertically elongated combustion zone having means for substantially impeding vertical backmixing of vertically moving solids substantially throughout the combustion zone;

(h) introducing at least a portion of the hot char into a lower portion of the combustion zone;

(i) heating the heat-transfer material to an elevated temperature in the combustion zone by contacting the heat-transfer material with the hot char while maintaining substantially countercurrent plug flow of the heat-transfer material and the hot char by passing air upwardly through the combustion zone at a rate sufficient to fluidize the heat-transfer material and entrain the hot char, whereby the heat-transfer material substantially flows downwardly through the combustion zone in a fluidized state and is heated to an elevated temperature while the hot char substantially flows upwardly through the combustion zone in an entrained state and is combusted; and (j) recycling at least a portion of the heat-transfer material to the reaction vessel.

7. A method for the gasification of coal comprising:

(a) introducing a coal into a lower portion of a vertically elongated reaction vessel having a lower portion, an upper portion, and a re-entrainment zone, wherein said re-entrainment zone is located above the upper portion, wherein the effective diameter of the lower portion of said vessel is greater than the effective diameter of the re-entrainment zone, wherein the effective diameter of the upper portion of said vessel is larger than the effective diameter of the lower portion of said vessel and the effective diameter of the re-entrainment zone, and wherein said reaction vessel has a means for substantially impeding vertical backmixing of vertically moving solids in said vessel;

(b) introducing sand into the upper portion of said vessel, the physical characteristics of the sand and the coal differing such that a superficial velocity of a fluid flowing upwardly through the lower portion of said vessel is greater than the minimum fluidizing velocity of the sand and the terminal velocity of the coal, but is less than the terminal velocity of the sand;

(c) passing steam upwardly through said vessel at a rate sufficient to fluidize the sand and entrain the coal in the lower portion of said vessel to maintain substantially countercurrent vertical flow of the sand and coal in said vessel without substantial top-to-bottom backmixing of the sand and the coal in the lower portion of said vessel; whereby the steam reacts with the coal to form a hot char and a gaseous product, wherein the heat necessary for this reaction is supplied by the sand; whereby the sand substantially flows downwardly in the reaction vessel, through the upper portion of said vessel and in a fluidized state through the lower portion of said vessel; whereby the coal substantially flows upwardly in the reaction vessel, in an entrained state through the lower portion of said vessel and the re-entrainment zone, and in a fluidized state through the upper portion of said vessel;

(d) removing the sand from the lower portion of said vessel at a temperature substantially lower than the temperature at which the sand was introduced into said vessel;

(e) introducing at least a portion of the sand into an upper portion of a vertically elongated combustion zone having means for substantially impeding vertical backmixing of vertically moving solids substantially throughout the combustion zone;

(f) removing the hot char and the gaseous product from the re-entrainment zone of said vessel, separating the hot char from the gaseous product, and introducing at least a portion of the hot char into a lower portion of the combustion zone;

(g) heating the sand to an elevated temperature in the combustion zone by contacting the sand with the hot char while maintaining substantially countercurrent plug flow of the sand and the hot char by passing air upwardly through the combustion zone at a rate sufficient to fluidize the sand and entrain the hot char, whereby the sand substantially flows downwardly through the combustion zone in a fluidized state and is heated to an elevated temperature while the hot char substantially flows upwardly through the combustion zone in an entrained state and is combusted; and (h) recycling at least a portion of the sand to the reaction vessel.

* * * * *